US008976206B2

(12) United States Patent
Kim et al.

(10) Patent No.: US 8,976,206 B2
(45) Date of Patent: Mar. 10, 2015

(54) DISPLAY DEVICE AND METHOD DRIVING THE SAME

(71) Applicants: Tae Gung Kim, Paju-si (KR); Kyoung Don Woo, Paju-si (KR); Moo Kyoung Hong, Changwon-si (KR)

(72) Inventors: Tae Gung Kim, Paju-si (KR); Kyoung Don Woo, Paju-si (KR); Moo Kyoung Hong, Changwon-si (KR)

(73) Assignee: LG Display Co., Ltd., Seoul (KR)

( * ) Notice: Subject to any disclaimer, the term of this patent is extended or adjusted under 35 U.S.C. 154(b) by 90 days.

(21) Appl. No.: 13/713,531

(22) Filed: Dec. 13, 2012

(65) Prior Publication Data

US 2013/0147861 A1 Jun. 13, 2013

(30) Foreign Application Priority Data

Dec. 13, 2011 (KR) ..... 10-2011-0134075

(51) Int. Cl.
*G09G 5/10* (2006.01)
*G09G 3/36* (2006.01)

(52) U.S. Cl.
CPC ..... *G09G 5/10* (2013.01); *G09G 3/3688* (2013.01); *G09G 3/3696* (2013.01); *G09G 2320/0673* (2013.01); *G09G 2330/021* (2013.01)
USPC ..... 345/690

(58) Field of Classification Search
CPC ..... G09G 2330/21; G09G 3/3688
See application file for complete search history.

(56) References Cited

U.S. PATENT DOCUMENTS

2003/0218591 A1* 11/2003 Shen et al. ..... 345/89
2005/0007393 A1 1/2005 Akai et al.
2005/0122321 A1* 6/2005 Akai et al. ..... 345/204
2009/0040158 A1 2/2009 Chuang
2009/0079678 A1* 3/2009 Ozawa ..... 345/77
2009/0160880 A1 6/2009 Park et al.
2011/0273425 A1* 11/2011 Kojima et al. ..... 345/211
2012/0223975 A1* 9/2012 Hsu et al. ..... 345/690

FOREIGN PATENT DOCUMENTS

KR 10-2009-0022023 A 3/2009
KR 10-2011-0074348 A 6/2011

OTHER PUBLICATIONS

Taiwan Patent Office, Office Action, Taiwan Patent Application No. 101146969, Sep. 2, 2014, six pages.

* cited by examiner

*Primary Examiner* — Kathy Wang-Hurst
*Assistant Examiner* — Peijie Shen
(74) *Attorney, Agent, or Firm* — Fenwick & West LLP

(57) ABSTRACT

A display device is disclosed. The device includes: a timing controller configured to derive data signals for a display panel from external signals; a date driver configured to derive data voltages from the data signals and apply the data voltage to data lines on the display panel; a gamma IC (integrated circuit) chip configured to apply gamma voltages to the data driver; a power supply IC chip configured to apply a most significant voltage to the data driver; a DAC (digital-to-analog converter) configured to receive the gamma voltages and the most significant voltage from the gamma IC chip and the power supply IC chip and generate the data voltages opposite to the data signals; and a power supply unit configured to convert the gamma voltages and the most significant voltage using the data signals and apply the converted voltages to the DAC.

12 Claims, 6 Drawing Sheets

DISPLAY DEVICE AND METHOD DRIVING THE SAME

CROSS-REFERENCE TO RELATED APPLICATION

The present application claims priority under 35 U.S.C. §119(a) of Korean Patent Application No. 10-2011-0134075 filed on Dec. 13, 2011, which is hereby incorporated by reference in its entirety.

BACKGROUND

1. Field of the Disclosure

Embodiments relate to a display device. Also, embodiments relate to a method of driving a display device.

2. Description of the Related Art

A variety of display devices adapted to display information are being developed. The display devices include liquid crystal display (LCD) devices, plasma display panel (PDP) devices, electrophoresis display devices, organic light-emitting display (OLED) devices and semiconductor light-emitting display devices, as an example.

Among the display devices, the LCD device or the OLED device includes a display panel and a driver circuit driving sub-pixels which are arranged on the display panel in a matrix shape. The driver circuit includes a timing controller, a gate driver, a data driver and so on. The data driver controls the sub-pixels and allows an image to be displayed. To this end, the data driver converts data signals into data voltages by extracting gamma voltages corresponding to the data signals and applies the data voltages to the display panel.

In this manner, the gamma voltages are applied to the data driver and used to convert the data signal which is a digital signal into the data voltage that is an analog signal. Such gamma voltages are constantly fixed. Thus, unnecessary power can be consumed. The unnecessary power consumption causes a gamma voltage generator and the data driver to generate heat.

BRIEF SUMMARY

Accordingly, the present embodiments are directed to a display device and a driving method thereof that substantially obviate one or more problems due to the limitations and disadvantages of the related art.

An aspect of the present embodiments is to provide a display device and a driving method thereof that are adapted to reduce power consumption.

Another aspect of the present embodiments is to provide a display device and a driving method thereof that are adapted to prevent the generation of heat.

Additional features and advantages of the embodiments will be set forth in the description which follows, and in part will be apparent from the description, or may be learned by practice of the embodiments. The advantages of the embodiments will be realized and attained by the structure particularly pointed out in the written description and claims hereof as well as the appended drawings.

According to one general aspect of the present embodiment, a display device includes: a timing controller configured to derive data signals for a display panel from external signals; a date driver configured to derive data voltages from the data signals and apply the data voltages to data lines on the display panel; a gamma IC (integrated circuit) chip configured to apply gamma voltages to the data driver; a power supply IC chip configured to apply a most significant voltage to the data driver; a DAC (digital-to-analog converter) configured to receive the gamma voltages and the most significant voltage from the gamma IC chip and the power supply IC chip and generate the data voltages opposite to the data signals; and a power supply unit configured to convert the gamma voltages and the most significant voltage using the data signals and apply the converted voltages to the DAC.

A driving method of a display device according to another general aspect of the present embodiment includes: storing data signals applied from a timing controller; extracting the data signals; calculating output voltage values based on the data signals; adjusting output voltages of a power supply IC chip and a gamma IC chip to be the calculated voltage values; and outputting the stored data signals to a display panel using the adjusted output voltages.

Other systems, methods, features and advantages will be, or will become, apparent to one with skill in the art upon examination of the following figures and detailed description. It is intended that all such additional systems, methods, features and advantages be included within this description, be within the scope of the invention, and be protected by the following claims. Nothing in this section should be taken as a limitation on those claims. Further aspects and advantages are discussed below in conjunction with the embodiments. It is to be understood that both the foregoing general description and the following detailed description of the present disclosure are exemplary and explanatory and are intended to provide further explanation of the disclosure as claimed.

BRIEF DESCRIPTION OF THE DRAWINGS

The accompanying drawings, which are included to provide a further understanding of the embodiments and are incorporated in and constitute a part of this application, illustrate embodiment(s) of the invention and together with the description serve to explain the disclosure. In the drawings.

DETAILED DESCRIPTION

Figure 1:
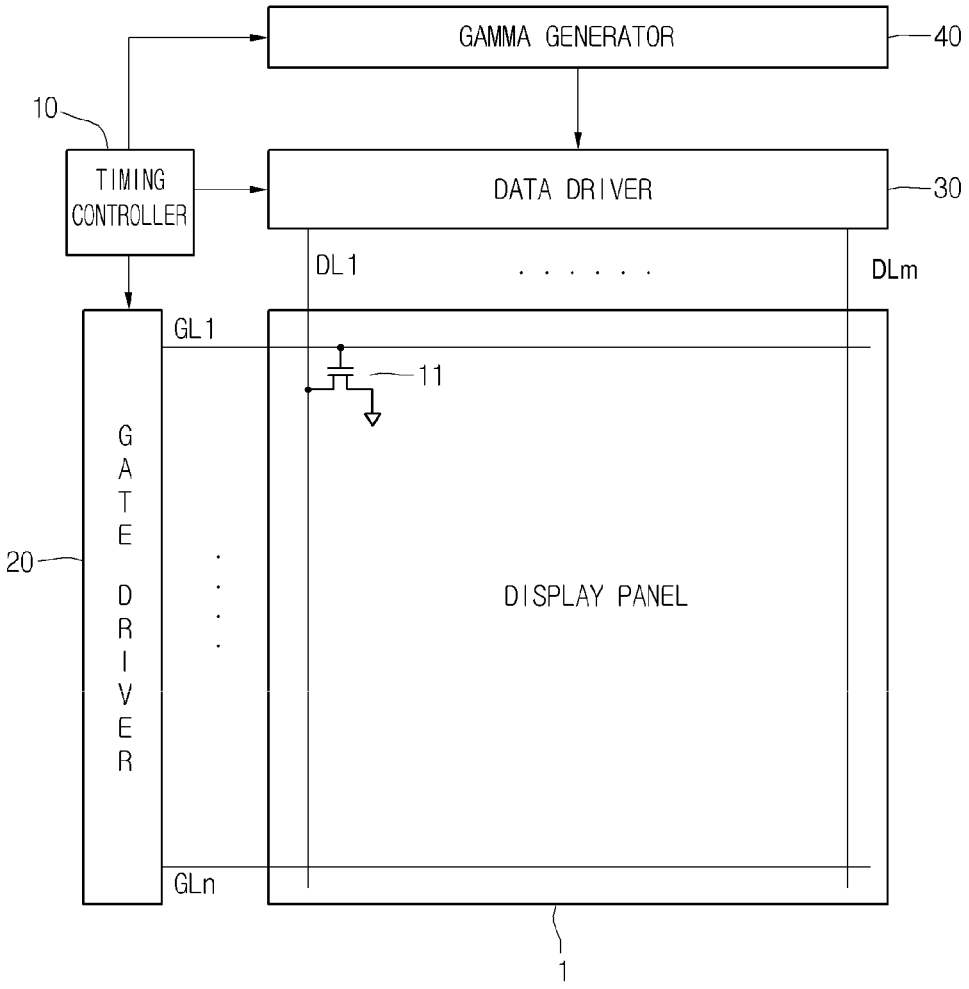
FIG. 1 is a block diagram showing a display device according to an embodiment of the present disclosure.

Reference will now be made in detail to the embodiments of the present disclosure, examples of which are illustrated in the accompanying drawings. These embodiments introduced hereinafter are provided as examples in order to convey their spirits to the ordinary skilled person in the art. Therefore, these embodiments might be embodied in a different shape, so are not limited to these embodiments described here. Also, the size and thickness of the device might be expressed to be exaggerated for the sake of convenience in the drawings.

Wherever possible, the same reference numbers will be used throughout this disclosure including the drawings to refer to the same or like parts.

FIG. 1 is a block diagram showing a display device according to an embodiment of the present disclosure.

Referring to FIG. 1, the display device according to the present embodiment can include a display panel 1, a timing controller 10, a gate driver 20, a data driver 30 and a gamma generator 40.

A plurality of gate lines GL1~GLn and a plurality of data lines DL1~DLm can be formed the display panel 1. Also, a plurality of thin film transistors 11 can be formed on the display panel 1. Each thin film transistor 11 can be electrically connected to one of the gate lines GL1~GLn and one of the data lines DL1~DLm.

The timing controller 10 can receive data signals, a data clock signal Dclk, a vertical signal Vsync, a horizontal synchronous signal Hsync and so on from an external graphic card (not shown). The timing controller 10 derives timing control signals from the data clock signal Dclk, the vertical synchronous signal Vsync and the horizontal synchronous signal Hsync. The timing control signals are used to control the gate driver 20 and the data driver 30. As such, the timing control signals can include gate control signals and data control signals.

The gate control signals can include a gate start pulse GSP, a gate shift clock GSC and a gate output enable signal GOE, as an example. The gate start pulse GSP is used to control a driving start time point of the first gate line GL1 of the display panel 1 in every frame. The gate shift clock GSC is used to sequentially control driving start time points of the gate lines GL1~GLn of the display panel 1. The gate output enable signal GOE is used to control a time point when gate signals are applied to the respective gate lines GL1~GLn.

The data control signals can include a source start pulse SSP, a source shift clock SSC, a source output enable signal SOE, a polarity signal POL and so on. The source start pulse SSP is used to control a supply start time point for one line of data signals every horizontal period. The source shift clock SSC is used to sequentially control supply time points of the data signals. The source output enable signal SOE is used to control a supply time point for one line of data voltages which are applied from the data driver to the display panel 1. The polarity signal POL is used to select polarities of the data voltages. In other words, the polarity signal POL enables each of the data voltages to selectively have one of a positive level and a negative level.

Also, the timing controller 10 can rearrange the data signals applied from the graphic card in a data format required by the data driver 30. The rearranged data signals are applied from the timing controller 10 to the data driver 30.

The gamma generator 40 can derive gamma voltages from a supply voltage which is applied from a power supply unit (not shown). The power supply unit can be included in the timing controller 10. The gamma generator 40 may generate a plurality of gamma voltages, corresponding to the number of gray levels, from the supply voltage. The plurality of gamma voltages can be applied from the gamma generator 40 to the data driver 30. To this end, the gamma generator 40 can include a gamma IC (Integrated circuit) chip.

The gate driver 20 can reply to the gate control signals applied from the timing controller 10 and sequentially generate the gate signals by sequentially shifting the voltage levels of the gate signals to a gate driving voltage level which enables the thin film transistors on pixel regions of the display panel 1 to be driven. The gate driver 20 can include a shift register for sequentially shifting the voltage levels of the gate signals to the gate driving voltage level. The gate signals are applied from the gate driver 20 to the regions of the display panel 1 through the gate lines GL1~GLn.

The data driver 30 can reply to the data control signals applied from the timing controller 10 and modify serial data signals into parallel data signals by sampling and latching the data signals which are sequentially applied from the timing controller 10. Also, the data driver 30 converts the parallel data signals that are digital signals into the parallel data voltages that are analog signals using the gamma voltages. The converted data voltages are applied from the data driver 30 to the pixel regions of the display panel 1 through the data lines DL1~DLm.

The thin film transistors 11 are turned on/off by the respective gate signals and transfer the respective data voltages to the respective pixel regions. In accordance therewith, an image can be displayed.

Figure 2:
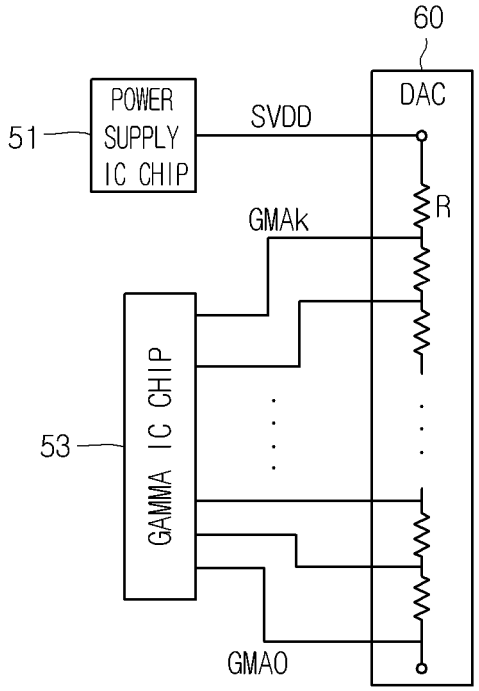
FIG. 2 is a circuit diagram showing a gamma voltage generator of the display device according to an embodiment of the present disclosure.

FIG. 2 is a detailed circuit diagram showing a gamma generator of the display device according to an embodiment of the present disclosure.

Referring to FIG. 2, the gamma generator according to an embodiment can include a power supply IC chip 51, a gamma IC chip 53 and a DAC 60.

The power supply IC chip 51 can apply driving voltages to the gamma IC chip 53 and the DAC 60. Also, the power supply IC chip 51 can apply a most significant voltage SVDD to the DAC 60. The power supply IC chip 51 can adjust the level of the most significant voltage SVDD with response to a control signal (not shown) applied from the timing controller 10.

The gamma IC chip 53 can be a programmable gamma IC chip. The gamma IC chip 53 can generate a plurality of gamma reference voltages GMAO~GMAk. Also, the gamma IC chip 53 can alter the plurality of gamma reference voltages GMAO~GMAk only through a reprogramming process. Further, the gamma IC chip 53 can adjust levels of the plural gamma reference voltages GMAO~GMAk according to a control signal (not shown) applied from the timing controller 10.

The DAC 60 can generate the plurality of gamma voltages using the plurality of gamma reference voltages GMAO~GMAk applied from the gamma IC chip 53. To this end, the DAC 60 can include a plurality of resistors connected to one another. The DAC 60 divides the plurality of gamma reference voltages GMAO~GMAk using the resistors connected in series and generates the plurality of gamma voltages. Also, the DAC 60 can convert the data signals applied from the timing controller 10 into the data voltages using the plurality of gamma voltages. The data voltages are applied from the DAC 60 to the data lines DL1~DLm on the display panel 1. Such a DAC 60 can be included in either the data driver 30 or the gamma generator 40.

Figure 3:
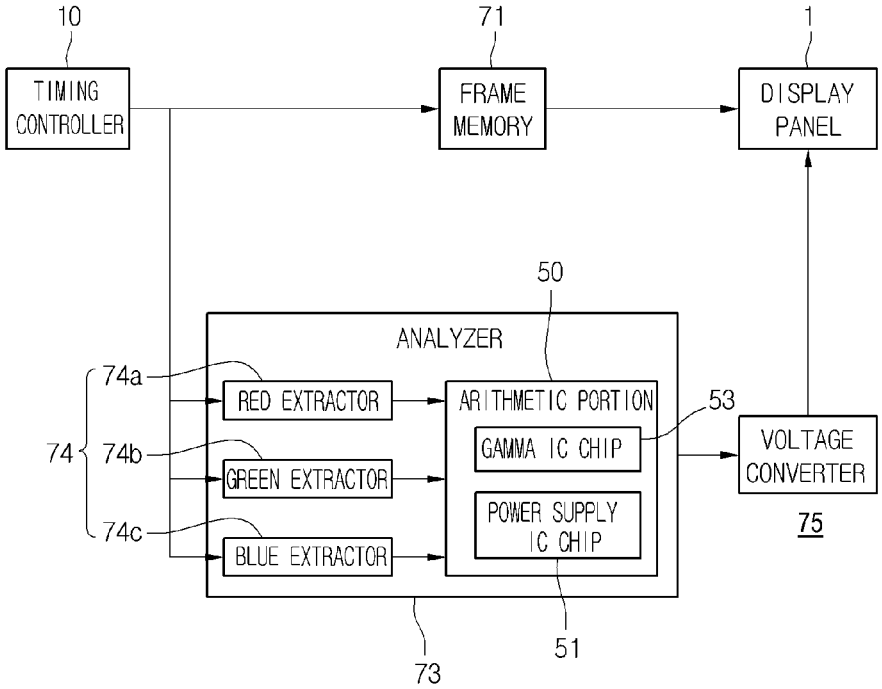
FIG. 3 is a block diagram showing a power conversion scheme of the display device according to an embodiment of the present disclosure.

FIG. 3 is a block diagram showing a power conversion system of the display device according to an embodiment of the present disclosure.

Referring to FIG. 3, the power conversion system of the display device according to an embodiment of the present disclosure includes a frame memory 71, an analyzer 73, a voltage converter 75.

The externally received data signals are transmitted to the frame memory 71 and the analyzer 73 through the timing controller 10. The data signals can be stored in the frame memory 71. In other words, the frame memory 71 has a function of temporarily storing a single frame of data signals.

The analyzer 73 can include an extraction portion 74 and an arithmetic portion 50.

The data signals transmitted to the analyzer 73 can be input to the extraction portion 74. The extraction portion 74 extracts histogram information, which is necessary to perform a power conversion in the display device, from the data signals.

To this end, the extraction portion can include a red extractor 74*a*, a green extractor 74*b* and a blue extractor 74*c*. The red extractor 74*a* can extract red data signals from the data signals. The green extractor 74*b* can extract green data signals from the data signals. The blue extractor 74*c* can extract blue data signals from the data signals.

The extraction portion 74 can extract the histogram information from each of the color data signals. The histogram information can include a maximum gray level, a minimum gray level and unused middle gray levels for each color data component. More specifically, the red extractor 74*a* can extract red histogram information, which includes the maximum, minimum and unused middle gray levels of the red data component, from the red data signals. Similarly, the green extractor 74*b* can extract green histogram information, which includes the maximum, minimum and unused middle gray levels of the green data component, from the green data signals. The blue extractor 74*c* can also extract blue histogram information, which includes the maximum, minimum and unused middle gray levels of the blue data component, from the blue data signals.

Such histogram information extracted by the extraction portion 74 can be applied to the arithmetic portion 50. The arithmetic portion 50 can determine the most significant voltage SVDD to be output from the power supply IC chip 51 and the gamma reference voltages to be output from the gamma IC chip 53, using the histogram information.

The arithmetic portion 50 can compare the extracted maximum gray levels of the red, green and blue data components to the most significant voltage SVDD and adjust the most significant voltage SVDD. If the most significant voltage SVDD is higher than the extracted maximum gray levels, the most significant voltage SVDD can be adjusted to be a voltage level corresponding to the highest one of the extracted maximum gray level. Actually, the most significant voltage SVDD corresponds to a large factor in entire power consumption of the display device. As such, the most significant voltage SVDD adjusted to correspond to the highest maximum gray level can reduce power consumption of the display device without distorting an image.

The arithmetic portion 50 can also adjust the gamma reference voltages of each color data component, which are output from the gamma IC chip 53, on the basis of the minimum gray levels and the unused middle gray levels for each of the red, green and blue data components. More specifically, the gamma reference voltages corresponding to the unused middle gray levels can be equally divided or set to be a lower gamma reference voltage compared to their own. As such, power consumption caused by the gamma voltages corresponding to the unused middle gray levels can be reduced. When some gamma reference voltages are set to be the same, power consumption can be further reduced. In accordance therewith, the high gamma reference voltages corresponding to the unused middle gray levels above the maximum gray level of each of the color data components can be adjusted to be a gamma reference voltage that is lower than their own but corresponding to the extracted maximum gray level. Also, the low gamma reference voltages corresponding to the unused middle gray levels below the extracted minimum gray level of each color data component can be equally divided or adjusted to be either a gamma reference voltage that is higher than their own but corresponding to the extracted minimum gray level or the ground voltage.

The gamma IC chip 53 has CMOS properties. As such, the more the gamma reference voltages are close to the most significant voltage SVDD or a ground voltage, the more power consumption can be reduced. In accordance therewith, power consumption can be reduced by adjusting the gamma reference voltages for at least one of the red, green and blue data components. If only the data signals corresponding to a red image, i.e., red data signals of the red data component are input, the gamma IC chip 53 can enable the gamma reference voltages for both of the green and blue data components to become the ground voltage or the most significant voltage SVDD, in order to reduce power consumption. Meanwhile, when the data signals corresponding to a white image are input, the gamma IC chip 53 can enable all gamma reference voltages higher than a gamma reference voltage corresponding to a maximum gray level of the white image to be adjusted to the same as the gamma reference voltage corresponding to the maximum gray level of the white image, in order to reduce power consumption.

The analyzer 73 enables most significant voltage SVDD generated in the power supply IC chip 51 as well as the gamma reference voltages generated in the gamma IC chip 53 to be applied to the voltage converter 75. The voltage converter 75 can apply the most significant voltage SVDD and the gamma reference voltages to the data driver of display panel 1 for each frame. Also, the data signals temporarily stored in the frame memory 71 are applied to the data driver of display panel 1. As such, the data driver of display panel 1 can convert the data signals from the frame memory 71 into the data voltages using the most significant voltage SVDD and the gamma reference voltages which are applied from the voltage converter 75. The data voltages converted by the data driver 30 are applied to the display panel 1 so that an image is displayed on the display panel 1.

In this manner, the gamma reference voltages and the gamma voltages can be adjusted according to the image. As such, power consumption of the display device can be reduced, and the heat generation in the data driver can be prevented or minimized.

Figure 4A:
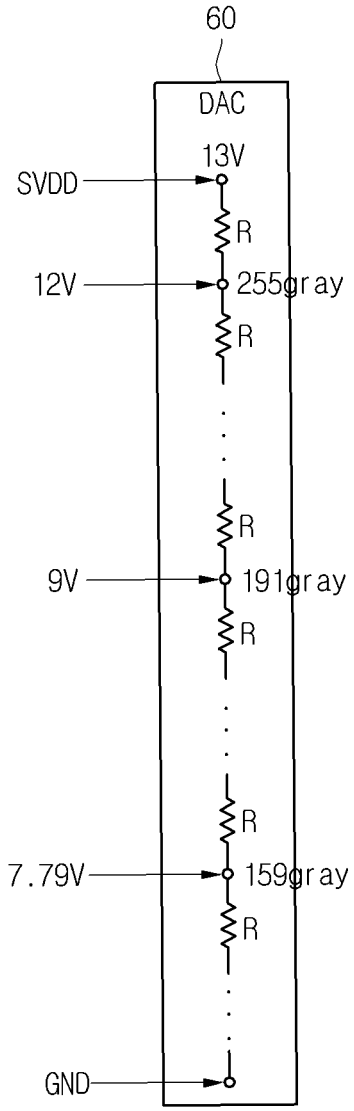
FIG. 4A is a circuit diagram illustrating voltages that are applied to a DAC (Digital-to-Analog Converter) of the related art display device.
Figure 4B:
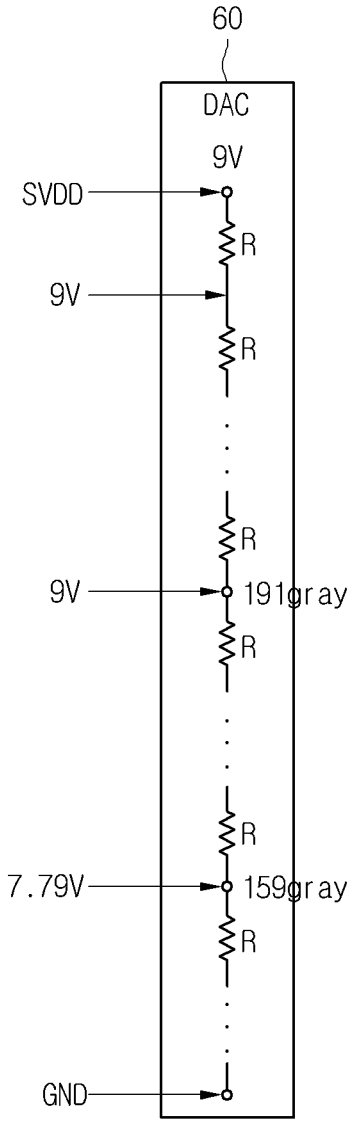
FIG. 4B is a circuit diagram illustrating voltages that are applied to a DAC of the display device according to an embodiment of the present disclosure.

FIG. 4A is a circuit diagram illustrating voltages that are applied to a DAC of the related art display device. FIG. 4B is a circuit diagram illustrating voltages that are applied to a DAC of the display device according to an embodiment of the present disclosure.

As shown in FIG. 4A, the voltage applied to the DAC 60 of the related art display device can include the most significant voltage SVDD generated in the power supply IC chip 51, and the plurality of gamma reference voltages. The DAC 60 can be configured to include a plurality of resistors R connected in series. The plurality of resistors R connected in series voltage-divides the most significant voltage SVDD and the plurality of gamma reference voltages and generates a plurality of gamma voltages corresponding to the number of gray levels of the data signal. Also, the DAC 60 converts the data signals into the data voltages using the plurality of gamma voltages and applies the converted data voltages to the data lines on the display panel.

Referring to FIG. 4B, the voltages applied to the DAC 60 include the most significant voltage SVDD and the plurality of gamma reference voltages which are adjusted by the analyzer 73 of FIG. 3.

If the data signals applied to the timing controller include only the red data component with 159~191 gray levels, the red data signals are temporarily stored into the frame memory and simultaneously applied to the red extractor. As such, the histogram information including a maximum gray level of 191, a minimum gray level of 159 and unused middle gray levels of 0~158 and 192~255 can be extracted from the red data signals by means of the red extractor.

The extracted histogram information applied to the arithmetic portion enables the most significant voltage SVDD of 13V that is higher than a gamma reference voltage of 9V corresponding to the extracted maximum gray level of 191 to be adjusted to be 9V corresponding to the gray level of 191.

The gamma reference voltages corresponding to the unused middle gray levels of 0~158 are adjusted to be the same as the gamma reference voltage of 7.79V corresponding to the extracted minimum gray level of 159. In other words, the gamma reference voltages corresponding to the gray levels of 0~158 are adjusted to be 7.79V.

Meanwhile, the other gamma reference voltages corresponding to the unused middle gray levels of 192~255 are also adjusted to be the same as the gamma reference voltage of 9V corresponding to the extracted maximum gray level of 191. In other words, the gamma reference voltages corresponding to the gray levels of 192~255 are adjusted to be 9V.

Moreover, the gamma reference voltages for green and blue data components are adjusted to be the most significant voltage of 9V or the ground voltage. Such adjusted most significant voltage and gamma reference voltages can force power consumption to be reduced.

Figure 5:
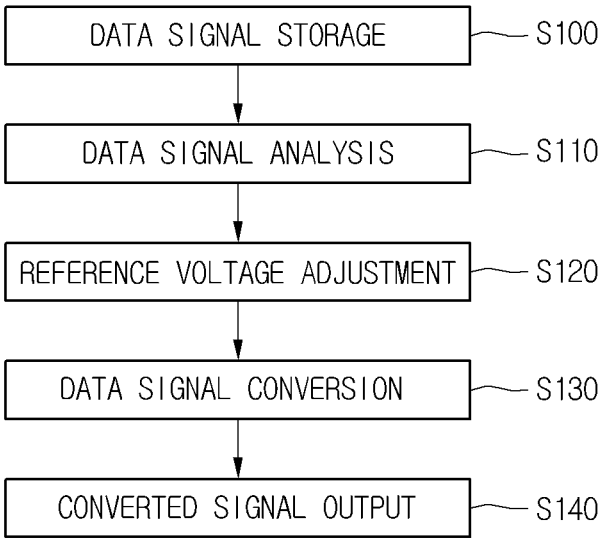
FIG. 5 is a flow chart illustrating a driving method of the display device according to an embodiment of the present disclosure.

FIG. 5 is a flow chart illustrating a driving method of the display device according to an embodiment of the present disclosure.

Referring to FIG. 5, a driving method of the display device according to the present embodiment can include the steps of storing the data signals (S100), analyzing the data signals (S110), adjusting reference voltages (S120), converting data signal into data voltages (S130), and outputting the converted data voltages (S140).

The data signals applied from the timing controller 10 are stored in the frame memory 71 at the data signal storage step (S100).

While the data signals are stored in the frame memory 71, the analyzer 73 extracts histogram information from the data signals applied from the timing controller 10 (S110). The histogram information obtained in the data signal analysis step (S110) is used in the power conversion scheme of the display device. The data signal analysis step (S110) enables red, green and blue data components that can be divided from the data signals. Also, a maximum gray level, a minimum gray level and unused gray levels for each of red, green and blue data components can be extracted through the analysis of the red, green and blue data components. As such, the histogram information can include the maximum gray level, the minimum gray level and the unused middle gray levels for each of the red, green and blue data components (or signals).

A most significant voltage SVDD and a plurality of gamma reference voltages can be adjusted using the histogram information extracted in the data signal analysis step of S110 (S120). More specifically, the reference voltage adjustment step of S120 can determine the most significant voltage SVDD being output from the power supply IC chip 51 and the plurality of gamma reference voltages being output from the gamma IC chip 53 on the basis of the histogram information. More specifically, the most significant voltage SVDD can be compared with the extracted maximum gray levels of the red, green and blue data components. If the most significant voltage SVDD is higher than the highest one of the extracted maximum gray levels, the most significant voltage SVDD can be adjusted to be a voltage level corresponding to the highest maximum gray level. Actually, the most significant voltage SVDD being output from the power supply IC chip 51 corresponds to a large factor of the entire power consumption of the display device. As such, the most significant voltage SVDD adjusted to correspond to the highest maximum gray level can reduce power consumption of the display device without distorting an image.

The reference voltage adjustment step of S120 can also allow the gamma reference voltages of each color data component, which are output from the gamma IC chip 53, to be adjusted on the basis of the maximum gray level, the minimum gray level and the unused middle gray levels for each of the red, green and blue data components. More specifically, the gamma reference voltages corresponding to the unused middle gray levels can be equally divided or set to be a gamma reference voltage providing low power consumption. As such, power consumption caused by the gamma voltages corresponding to the unused middle gray levels can be reduced. When some gamma reference voltages are set to be the same, power consumption can be further reduced. In accordance therewith, the high gamma reference voltages corresponding to the unused middle gray levels above the maximum gray level of each color data components can be adjusted to be a gamma reference voltage being lower than their own but corresponding to the extracted maximum gray level. Also, the low gamma reference voltages corresponding to the unused middle gray levels below the extracted minimum gray level of each color data component can be adjusted to be a gamma reference voltage being higher than their own but corresponding to the extracted minimum gray level.

The gamma IC chip 53 has CMOS properties. As such, the more the gamma reference voltages are close to the most significant voltage SVDD or a ground voltage, the more power consumption can be reduced. In accordance therewith, power consumption can be reduced by adjusting the gamma reference voltages for at least one of the red, green and blue data components. If only the data signals corresponding to a red image, i.e., red data signals of the red data component are input, the gamma IC chip 53 can enable the gamma reference voltages for both of the green and blue data components to become the ground voltage or the most significant voltage SVDD, in order to reduce power consumption. Meanwhile, when the data signals corresponding to a white image are input, the gamma IC chip 53 can enable all gamma reference voltages higher than a gamma reference voltage corresponding to a maximum gray level of the white image to be adjusted to the same as the gamma reference voltage corresponding to the white image, in order to reduce power consumption.

The most significant voltage SVDD and the gamma reference voltages adjusted in the reference voltage adjustment step of S120 can be used in the data signal conversion step of S130. The data signal conversion step of S130 can enable a plurality of gamma voltages for each of the red, green and blue data components to be derived from the most significant voltage SVDD and the gamma reference voltages of each color data component. Also, the data signal conversion step of S130 can allows the data signals temporarily stored in the frame memory 71 to be converted into data voltages using the gamma voltages of the red, green and blue data components.

The data voltages converted in the data signal conversion step of S130 are applied to the display panel 1 so that an image is displayed on the display panel 1 (S140).

In this way, the gamma reference voltages and the gamma voltages can be adjusted according to the image. As such, power consumption of the display device can be reduced and the heat generation in the data driver can be prevented or minimized, without distorting the image.

It should be understood that numerous other modifications and embodiments can be devised by those skilled in the art that will fall within the spirit and scope of the principles of this disclosure. In other words, although embodiments have been described with reference to a number of illustrative embodiments thereof, this disclosure is not limited to those. Accordingly, the scope of the present disclosure shall be determined only by the appended claims and their equivalents. In addition, variations and modifications in the component parts and/or arrangements, alternative uses must be regarded as included in the appended claims.

What is claimed is:

1. A display device comprising:

a timing controller configured to derive data signals for a display panel from external signals;

a date driver configured to derive data voltages from the data signals and apply the data voltages to data lines on the display panel;

a gamma IC (integrated circuit) chip configured to apply gamma voltages to the data driver;

a power supply IC chip configured to apply a most significant voltage to the data driver;

a DAC (digital-to-analog converter) configured to receive the gamma voltages and the most significant voltage from the gamma IC chip and the power supply IC chip, respectively, and generate the data voltages corresponding to the data signals; and a power supply unit configured to convert the gamma voltages and the most significant voltage using the data signals and apply the converted gamma voltages and the converted most significant voltage to the DAC;

wherein the power supply unit includes an extraction portion configured to extract a maximum gray level, a minimum gray level, and unused middle gray levels of the data signals; and wherein the powers supply unit further includes a voltage converter configured to convert the calculated gamma voltages and the calculated most significant voltage, and wherein the voltage converter enables the gamma reference voltages corresponding to the unused middle gray levels to be adjusted to be at least one of gamma reference voltages corresponding to the maximum gray level and gamma reference voltages corresponding to the minimum gray level.

2. The display device of claim 1, wherein the power supply unit further includes:

an arithmetic portion configured to calculate the gamma voltages and the most significant voltage using the data signals.

3. The display device of claim 2, wherein the display device further includes a frame memory configured to store a single frame of the data signals.

4. The display device of claim 2, wherein the extraction portion extracts red data signals, green data signals and blue data signals.

5. The display device of claim 1, wherein the voltage converter converts the most significant voltage into a voltage value corresponding to the maximum gray level.

6. The display device of claim 4, wherein the gamma reference voltages for at least one of the red, green and blue data signals are adjusted to be either a ground voltage or a voltage corresponding to the maximum gray level.

7. The display device of claim 1, wherein the gamma IC chip is a programmable gamma IC chip capable of being reprogrammed.

8. The display device of claim 1, wherein the DAC is included in the data driver.

9. A method of driving a display device, the method comprising:

storing data signals applied from a timing controller;

extracting the data signals;

calculating output voltage values based on the data signals;

adjusting output voltages of a power supply IC chip and a gamma IC chip to be the calculated output voltage values; and outputting the stored data signals to a display panel using the adjusted output voltages;

wherein extracting the data signal comprises extracting a maximum gray level, a minimum gray level, and unused middle gray levels of the data signals; and wherein adjusting the output voltages comprises adjusting gamma reference voltages corresponding to the unused middle gray levels to at least one of gamma reference voltages corresponding to the maximum gray level and gamma reference voltages corresponding to the minimum gray level.

10. The method of claim 9, wherein the extraction of the data signals comprises extracting red data signals, green data signals and blue data signals.

11. The method of claim 9, wherein the adjustment of the output voltages comprises adjusting a most significant voltage of the power supply IC chip to a voltage value corresponding to the maximum gray level.

12. The method of claim 10, wherein gamma reference voltages for at least one of the red, green and blue data signals are adjusted to be either a ground voltage or a voltage corresponding to the maximum gray level.

* * * * *